US005596926A

United States Patent [19]

Zimmer

[11] Patent Number: 5,596,926

[45] Date of Patent: Jan. 28, 1997

[54] PROCESS AND APPARATUS FOR PRODUCING PRECISELY-REGISTERED ROTARY SCREENS

[76] Inventor: Johannes Zimmer, Ebentaler Str. 133, 9020 Klagenfurt, Germany

[21] Appl. No.: 949,147

[22] Filed: Sep. 23, 1992

[30] Foreign Application Priority Data

Sep. 23, 1991 [DE] Germany ..... 41 32 088.3

[51] Int. Cl.[6] ..... B41M 1/12; B41L 13/00

[52] U.S. Cl. ..... 101/129; 101/DIG. 36

[58] Field of Search ..... 101/116, 118, 101/128.1, 128.21, 128.4, 129, DIG. 36

[56] References Cited

U.S. PATENT DOCUMENTS 4,641,577 2/1987 Sweeny ..... 101/DIG. 36

4,909,143 3/1990 Van den Berg et al. ..... 101/118

*Primary Examiner*—Ren Yan

*Attorney, Agent, or Firm*—Fay, Sharpe, Beall, Fagan, Minnich & McKee

[57] ABSTRACT

A process and apparatus (1) for accurately registering rotary screens (2) includes end rings connected in rotation and sliding-proof manner to a screen drum without register notches. In a separate operation, a register notch (7) is made in an end ring (5) and a tool (20, 24) producing the register notch (7) is oriented to a screen register mark (13) by a given relative setting between the tool (20, 24) and the rotary screen (2). The apparatus (1) includes the tool (20, 24), a device (15) for reading the register mark (13) and for setting the relative position, and a depositing device (3) mounting the rotary screen (2).

23 Claims, 1 Drawing Sheet

PROCESS AND APPARATUS FOR PRODUCING PRECISELY-REGISTERED ROTARY SCREENS

Figure 1:
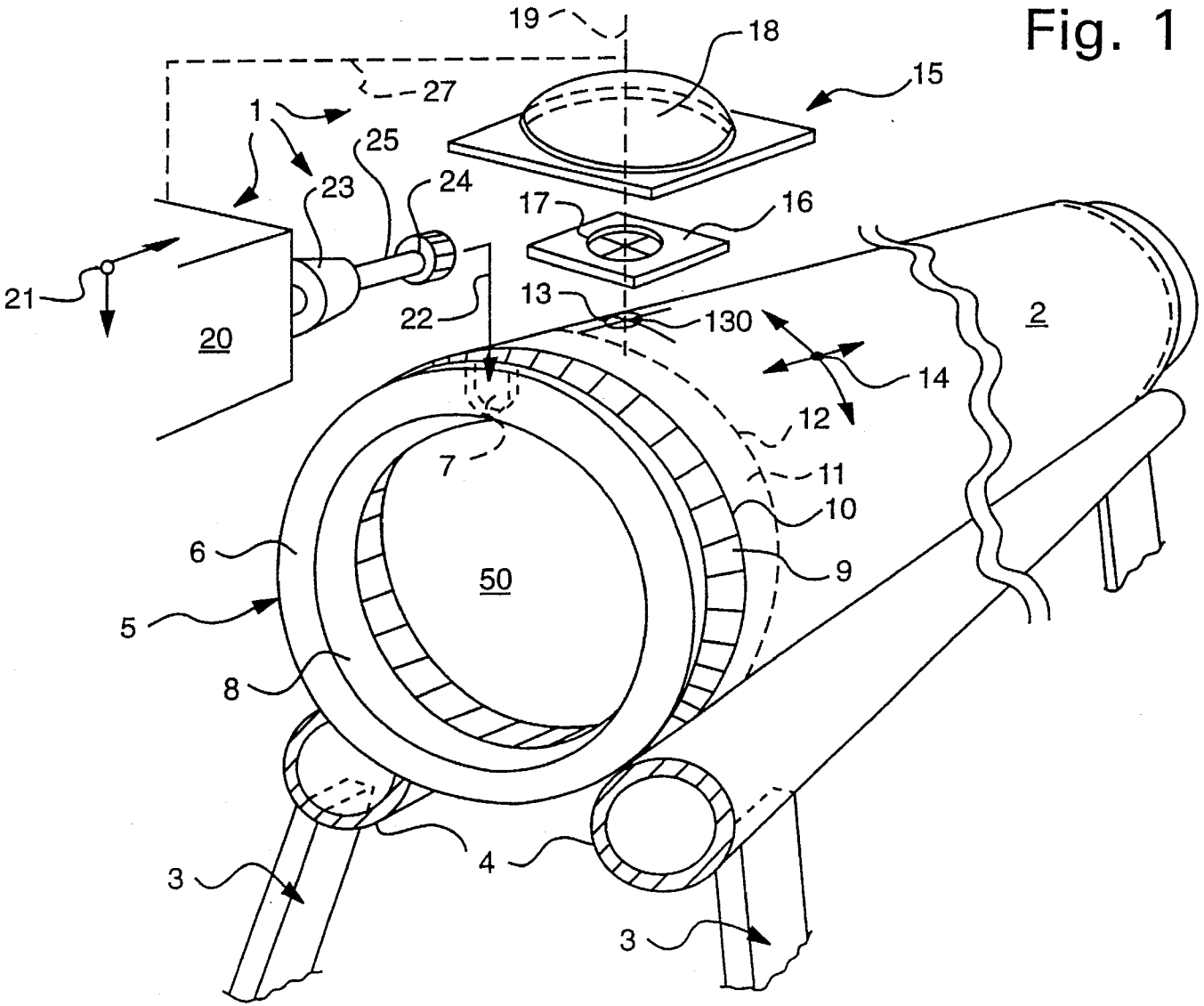

The present invention relates to a process for producing a precisely registered rotary screen for printing machines, as well as to an apparatus for performing the process.

Rotary screens or so-called revolving drum screens for printing machines normally have a wall thickness of approximately 0.1 mm and a diameter of approximately 200 to 500 mm. In accordance with standard fabric widths, the length of a revolving screen is approximately 150 to 350 cm and can be up to 500 cm for carpet printing.

A revolving screen is manufactured in such a way that in a revolving screen drum of the aforementioned type, following on to the perfect register patterning at each end of the thin-walled hollow drum, in each case one revolving screen end ring is bonded in or optionally also rivetted in.

These end rings normally have a flange, whose function is to fasten the screen in screen fastenings of a printing machine. Most printing machines are multicolor printing machines, in which several screens, which are necessary for printing a multicolour pattern, are simultaneously placed in juxtaposed or successive manner in the printing machine. For perfect register printing it is standard practice when producing the screen patterning to simultaneously place register marks on the edge or on both edges of the screens or to engrave same with the pattern, which precisely coincide from the register standpoint with the pattern-conditioned screen repeat (so-called longitudinal repeat in the screen circumferential direction and so-called transverse repeat in the screen longitudinal direction).

The prior art rotary screen production process takes place in such a way that prefabricated rotary screen end rings, in whose retaining flanges there are prefabricated register slits or notches, are bonded into the finished patterned or engraved rotary screen hollow drum. In said register slits or notches engage register bolts fitted to the screen holding parts of the printing machine, which brings about the screen insertion register and rotation prevention.

The retaining flange of the end ring engages in a retaining groove of the holding parts of the printing machine, which defines and fixes the transverse position of the screen, relative to the longitudinal extension of a material web to be printed.

The bonding of rotary screen end rings in the patterned rotary screen hollow drum is an operation which is particularly difficult to perform.

A trained person performing the bonding of the end rings into the screens has to make use of an optimized bonding procedure, because during printing the bond is highly stressed and must therefore be very durable, i.e. must have the optimum bonding quality. It must be ensured that the screens are stretched with a relatively high force between the mounting supports of the printing machine.

During the bonding work requiring high levels of attention, a trained person must also fulfil other difficult functions, i.e. apart from being very durable the bond must also be in perfect register form.

A complete perfect register bonding-in is sometimes impossible with rapidly curing adhesives. End rings bonded-in with an imperfect register increase the amount of adjustment work to take place on the printing machine as a result of correction and control measures which become additionally necessary. These have consequences which make working more difficult or impair the printing quality. If in a printing unit of a multicolor printing machine in which previously has been inserted a rotary screen with an imprecisely bonded-in end ring, subsequently another rotary screen with a different printing pattern is inserted, it is necessary to again correct the setting thereof, even if the end ring of the subsequently inserted screen is bonded-in in perfect register manner.

If an imprecise end ring bonding-in happens to affect the screen, which is inserted in the first printing unit of a multicolor printing machine, this has extremely disadvantageous consequences for all the screens inserted in the following printing units. Thus, all the screens of a pattern to be printed in e.g. ten color form must be corrected. However, in practice not only eight to ten, but frequently also twelve to sixteen and even twenty to twenty four color patterns are printed.

The above disadvantages impair the printing process and in particular reduce the economic effectiveness thereof, particularly as in general practice multicolor and therefore very high quality patterns have to be printed in relatively small numbers, i.e. with relatively short yardages. It is known that the productivity of a rotary screen printing machine can drop to below 50% as a result of the above difficulties.

If use is only made of a slowly curing adhesive for the bonding-in operation, this also has very disadvantageous consequences. Thus, it can occur that a bonding-in operation which has taken place in perfect register manner slips during subsequent manipulations of the screen, so that the same negative effects as described hereinbefore occur.

Another risk when handling screens with freshly bonded-in, but not yet reliably fixed, end rings, is that the latter slide into an initially unnoticed inclined position, which then during printing leads to noisy operation, so that printing inaccuracies and overstressing of the bonded joint occur in circumferential portions.

Screen manufacture and printing performance must be looked upon as an overall working process. From the operational standpoint this means that the quality and economics of the complete process, namely screen manufacture and use, is subdivided over both partial operations without any clear competence or responsibility demarcation. This leads to economic problems, which do not allow correct cost association on the basis of cause. Very disadvantageous effects are due to relatively small problems, which occur with the aforementioned prior art in connection with rotary screen manufacture and printing.

The problem of the invention is to provide a process for producing perfect register printing machine rotary screens and an apparatus for performing the process, which significantly improves, simplifies and makes more reliable screen manufacture, whilst also ensuring that for use and trouble-free operation free from particular setting tasks, the screens can be used in printing machines in reliable perfect register manner with the screen pattern.

According to the invention this problem is solved by a process for the manufacture of a perfect register rotary screen for printing machines and which has on its thin-walled screen drum a register mark precisely coinciding with the screen pattern register, and at each end of the screen drum is fixed a circular end ring particularly by means of rapidly curing adhesive and on at least one of the two end rings is provided a register notch (register slit) which can be made to coincide in perfect register manner with an associated screen register mark with respect to the screen circumferential direction (longitudinal repeat), characterized by the following process steps fixed in the given order: end rings without register notches are fitted to the screen drum;

and, following the production of a rotation and sliding-proof connection of the end rings to the screen cylinder, and particularly following the complete curing of an adhesive of a bonded joint, in a separate operation a register notch is made in the end ring in perfect register with the screen patterning (register mark (13)), a tool producing the register notch being oriented with the screen register mark by a given relative setting between the tool and the rotary screen.

A manufacturing apparatus developed in accordance with the invention for performing the process of the invention has a tool for producing the register notch, a reading/setting device connected to the tool for reading the screen register mark and for setting the perfect register relative position between the rotary screen and the tool, as well as a depositing device securing the tool and the rotary screen and preferably fixing them in a position set to the register mark.

The process or apparatus according to the invention are particularly suitable for producing perfect register rotary screens with end rings preferably bonded-in by means of a rapidly curing adhesive. Preferably the end ring notches are milled-in with a milling tool, whilst the fitting of the register notches can take place by some other random production procedure, and advantageously, e.g., by laser cutting. The adjustment of the fitting point of an end ring register notch coinciding with the screen pattern, i.e. with the screen register mark, is particularly simple and very accurate, because the rotary screen can be set by a simple setting device to the position defined by the screen register mark and can be locked in this position, the setting device being connected to the tool and is optionally movable and lockable together with the same relative to the screen, so that the tool in the adjusted-in position is always precisely oriented with the register notch fitting point coinciding with the register mark longitudinal repeat. As a function of the choice of the tool, it can engage frontally or preferably laterally in an end ring flange by movability in at least one of the two spatial directions.

Particular advantages of the invention are explained hereinafter relative to a rotary screen produced by bonding-in end rings.

If the end ring or rings are firmly bonded-in, i.e. the adhesive or bonded joint has cured, there is no possibility of any sliding or rotation of an end ring in the screen which would impair perfect register. Screens with firmly bonded-in end rings can also be much better and reliably handled than those with end rings which can still to a greater or lesser extent be moved or rotated prior to or following the production of the adhesive bond.

The aforementioned disadvantages of the prior art are effectively avoided according to the invention, because the person bonding-in the end rings, through the use of the inventive process or apparatus, is free from the usual difficult additional task of the accurate register production of the bond. The use of the process or apparatus according to the invention offers numerous advantages.

Compared with a conventional working process with a high level of difficulty and therefore considerable failure risk, the screen production operation or the bringing about of optimum registration is considerably improved with respect to the quality of the screen manufacture, the economic operation of a printing machine and the quality of the screen printing as a result of the present invention.

The conventional working procedure is particularly modified in three respects. The end rings to be bonded-in are produced without prefabricated register notches, which lack any reference to the screen register mark. The bonding-in of the end rings takes place without reference to a screen register mark or to the pattern register. When bonding-in the end rings, with regard to an accurate transverse repeat, attention must only be paid to the lateral register and the vertical angular position of the end ring with respect to the imaginary rotary screen drum axis and not to the circumferential position thereof.

However, particular reference is also made to the following advantages. To rotary screens, whose end rings have widened register notches with worn edges as a result of numerous uses, and whose register actions no longer satisfy the precision requirements, new register-based notches can be made at other circumferential positions of the screen or the retaining flange rings. From no longer required or no longer usable rotary screens it is possible to release the end rings, and these can be reused for producing new screens. The old register notches present are then ignored for the new manufacturing process.

A supplementary advantage regarding the improvement of quality and accuracy is that the rotary screens are simpler and more reliable to handle with end rings that a already firmly bonded-in, and which are therefore better set to a register mark and can be more reliably secured during the production of the register notch than was the case with the conventional working procedure.

To illustrate the above advantages it is pointed out that the wall thickness of a rotary screen hollow drum is only roughly 1/10 millimeters, and that consequently a screen hollow drum on which is not fixed any stabilizing end ring is so fragile and dimensionally unstable that it can scarcely be touched. Therefore, an end ring being bonded against register turning of a screen hollow drum requires a very high degree of skill, and consequently the necessary optimum quality is not always reached.

It is therefore clear that the invention has a high degree of technical and economic usefulness.

Specific embodiments of the invention are recited in the claims, whilst further advantages and embodiments of the invention are described hereinafter relative to FIG. 1, which is an overall view of an inventive apparatus illustrating the performance of the inventive process.

FIG. 1 shows an inventive apparatus 1 with a rotary screen 2, which rests on two crossbeams 4 in a depositing or support frame 3. Advantageously, use is made of a not-shown auxiliary device for holding a screen 2 set to a register mark 13 during the making of a register notch.

An end ring 5 is firmly bonded-in to the facing end of the rotary screen 2. The drawing shows a retaining flange ring 6 of the end ring 5 and a register notch or slit 7 for fitting (milling) in the flange ring 6 is shown in broken line form.

Following onto the retaining flange ring 6 there is an end ring neck 8 and following onto the latter an end ring sloping surface 9 which, following onto a second bend on a circumferential edge 10, passes into the adhesive surface 11 of the end ring 5 engaging on the inner circumference of the screen drum and terminates at the edge 12 indicated in broken line form.

In the frontal marginal area of the screen 2 is provided a register mark 13 coinciding in perfect register manner with a not-shown screen patterning. Reference numeral 14 represents the coordinates of a possible screen movement or adjustment for setting the register of the screen 2 in the inventive apparatus 1. The register setting is a preparatory measure for making the register notch 7 on the end ring 5. Preferably the beams 4 form a rotary bearing connected to a not-shown drive with which the rotary screen 2, in accordance with the coordinates 14, can be mounted adjustably in the circumferential and axial directions.

Reference numeral 15 designates a register mark reading and setting auxiliary device of the apparatus 1. A register setting part 16 of the reading/setting device 15 is e.g. constructed as a reticle 17 and as a further setting auxiliary device is shown a magnifying glass 18 for increasing the reading and setting accuracy.

A register reading and setting axis of the device 15 is designated by reference numeral 19, and in the illustrated adjusted-in position of the rotary screen 2 coincides with the register mark center 130 perpendicular to the screen circumferential surface. The reading/setting axis 19 is to be considered as a fixed apparatus axis of the setting device 15. A tool producing the register notch 7 and which in the present embodiment is in the form of a milling tool 24 inserted in a milling head 23, is connected by means of an apparatus part 27 to the device 15 so that the tool 24 or the milling device 20 is located in an imaginary apparatus plane, which is determined by the reading/setting axis 19 orientable with the register mark center 130 and an axis extending parallel to the screen. In this way the register mark reading device 15 and the register notch milling device 20 are fixed on the same line axially parallel to the rotary screen 2.

The movement coordinates of the milling device 20 provided for the precision milling process are designated by reference numeral 21. Bent arrow 22 makes clear the working movements corresponding to the coordinates 21. The milling device 20 is fixed in movable or slidable manner to the apparatus 1 by a support that is not specifically illustrated.

It is pointed out that the apparatus 1, with minor changes, can be used to advantage as an auxiliary device for bonding-in the end rings 5.

I claim:

1. A process for the manufacture of a precisely-registered rotary screen drum for a printing machine of the type utilizing a thin-walled screen drum, a screen register mark precisely coinciding with a screen pattern register, and two circular end rings each fixed to a respective end of the screen drum by an adhesive, at least one of the two end rings being provided with a register notch which can be made to coincide with the associated screen register mark with respect to a circumferential direction of the screen, comprising the steps of:

(a) fitting first and second end rings without register notches to first and second ends of a rotary screen drum having a screen register mark thereon;

(b) after step (a), providing a rotation-and sliding-proof connection for each of the first and second end rings to the respective ends of the rotary screen drum using an adhesive;

(c) curing the adhesive to form a bonded joint between each of the end rings and the rotary screen drum; and (d) after step (c), forming a register notch in at least one of the end rings in register with the screen register mark, using a tool that is oriented with the screen register mark in accordance with a given relative setting between the tool and the rotary screen drum.

2. A process according to claim 1, wherein step (d) includes the step of circumferentially and axially adjusting the rotary screen drum to register the rotary screen drum relative to the tool.

3. A process according to claim 1, wherein step (a) includes the step of bringing at least one of the end rings into a precise coaxial transverse register relative to the screen drum axis.

4. A process according to claim 2, wherein step (a) includes the step of bringing at least one of the end rings into a precise coaxial transverse register relative to the screen drum axis.

5. An apparatus for precisely registering a rotary screen drum for a printing machine, comprising:

a tool for producing a register notch in an end ring to be mounted to a rotary screen drum;

a rotary screen drum including a screen register mark;

a reading/setting device operably connected to the tool for reading the screen register mark and for setting a relative rotary screen drum registration position between the rotary screen drum and the tool with respect to the screen register mark; and a depositing device for mounting the rotary screen drum in the relative rotary screen drum registration position.

6. An apparatus according to claim 5, wherein the depositing device includes setting means for enabling the mounting of the rotary screen drum to be adjustable and optionally fixable in a circumferential direction thereof.

7. An apparatus according to claim 6, wherein the tool includes a milling device.

8. An apparatus according to claim 6, wherein the reading/setting device includes reading/register setting means, which can be made to coincide with the screen register mark and which includes a reticle, for enabling optical registration of the register mark and the tool.

9. An apparatus according to claim 6, further comprising means for orienting the tool and the reading/setting device so that the tool is always located in an imaginary plane which intersects a reading/setting axis of the reading/setting device, said reading/setting axis being orientable with respect to the screen register mark and an axis extending parallel with the rotary screen axis.

10. An apparatus according to claim 6, wherein the tool is movable towards an application point of the end ring register notch in at least one displacement direction.

11. An apparatus according to claim 6, wherein the tool includes a laser cutting device.

12. An apparatus according to claim 5, wherein the tool includes a milling device.

13. An apparatus according to claim 12, wherein the reading/setting device includes reading/register setting means, which can be made to coincide with the screen register mark and which includes a reticle, for enabling optical registration of the register mark and the tool.

14. An apparatus according to claim 12, further comprising means for orienting the tool and the reading/setting device so that the tool is always located in an imaginary plane which intersects a reading/setting axis of the reading/setting device, said reading/setting axis being orientable with respect to the screen register mark and an axis extending parallel with the rotary screen axis.

15. An apparatus according to claim 12, wherein the tool is movable towards an application point of the end ring register notch in at least one displacement direction.

16. An apparatus according to claim 12, wherein the tool includes a laser cutting device.

17. An apparatus according to claim 5, wherein the reading/setting device includes reading/register setting means, which can be made to coincide with the screen register mark and which includes a reticle, for enabling optical registration of the register mark and the tool.

18. An apparatus according to claim 17, further comprising means for orienting the tool and the reading/setting device so that the tool is always located in an imaginary plane which intersects a reading/setting axis of the reading/setting device, said reading/setting axis being orientable with respect to the screen register mark and an axis extending parallel with the rotary screen axis.

19. An apparatus according to claim 17, wherein the tool is movable towards an application point of the end ring register notch in at least one displacement direction.

20. An apparatus according to claim 5, further comprising means for orienting the tool and the reading/setting device so that the tool is always located in an imaginary plane which intersects a reading/setting axis of the reading/setting device, said reading/setting axis being orientable with respect to the screen register mark and an axis extending parallel with the rotary screen axis.

21. An apparatus according to claim 20, wherein the tool is movable towards an application point of the end ring register notch in at least one displacement direction.

22. An apparatus according to claim 5, wherein the tool is movable towards an application point of the end ring register notch in at least one displacement direction.

23. An apparatus according to claim 5, wherein the depositing device includes setting means for enabling the mounting of the rotary screen drum to be adjustable and optionally fixable in circumferential and axially directions thereof.

* * * * *